US010736406B2

(12) United States Patent
Hintze

(10) Patent No.: US 10,736,406 B2
(45) Date of Patent: Aug. 11, 2020

(54) TOOL RETAINING DEVICE

(71) Applicant: Ian Hintze, Lynbrook, NY (US)

(72) Inventor: Ian Hintze, Lynbrook, NY (US)

( * ) Notice: Subject to any disclaimer, the term of this patent is extended or adjusted under 35 U.S.C. 154(b) by 224 days.

(21) Appl. No.: 15/185,905

(22) Filed: Jun. 17, 2016

(65) Prior Publication Data

US 2016/0367020 A1 Dec. 22, 2016

Related U.S. Application Data

(60) Provisional application No. 62/182,330, filed on Jun. 19, 2015, provisional application No. 62/268,228, filed on Dec. 16, 2015.

(51) Int. Cl.
*A45F 5/00* (2006.01)
*A45F 5/02* (2006.01)

(52) U.S. Cl.
CPC ..... *A45F 5/004* (2013.01); *A45F 5/021* (2013.01); *A45F 2005/026* (2013.01); *A45F 2200/0575* (2013.01)

(58) Field of Classification Search
CPC .. A45F 5/004; A45F 5/021; A45F 5/02; A45F 2005/025–028; A45F 2005/1013; A45F 2200/0575; Y10S 224/904
USPC ..... 224/162, 674–675, 250, 904
See application file for complete search history.

(56) References Cited

U.S. PATENT DOCUMENTS

D203,101 S 12/1965 Holder
3,743,147 A 7/1973 Wilczynski
3,878,589 A 4/1975 Schaefer
4,598,027 A 7/1986 Johnson
4,754,528 A 7/1988 Lyons et al.
4,771,927 A 9/1988 Ventura
4,884,730 A * 12/1989 Carpenter ..... A45B 1/04 224/162
5,025,966 A 6/1991 Potter
5,347,693 A 9/1994 Otrusina
5,388,741 A * 2/1995 Hillinger ..... A45F 5/02 206/349
5,597,102 A * 1/1997 Saarikko ..... H04B 1/3822 224/191
5,730,342 A 3/1998 Tien
5,845,413 A * 12/1998 Zayat, Jr. ..... G01B 3/1084 33/760

(Continued)

FOREIGN PATENT DOCUMENTS

CN 2417003 Y 1/2001

OTHER PUBLICATIONS

"Magtite Magnetic Tape Holster" http://www.ustape.com/servlet/-strse-Magnetic-Tape-Holster/Categories Feb. 25, 2014.

(Continued)

*Primary Examiner* — Scott T McNurlen
(74) *Attorney, Agent, or Firm* — Hoffmann and Baron, LLP

(57) ABSTRACT

A tool retaining device including a strapping material including pliable material which is adapted to be wrapped around a tool to secure the strapping material to the tool. The strapping material is securely retained to a mounting lug, the mounting lug being securable to a tool by a fastener. A securement device has a slot therein for lockingly receiving the lug, and the lug is removably securable to the securement device.

14 Claims, 11 Drawing Sheets

(56) References Cited

U.S. PATENT DOCUMENTS

| | | | | |
|---|---|---|---|---|
| 5,850,954 | A | 12/1998 | Dong-Joo | |
| 5,957,421 | A | 9/1999 | Barbour | |
| 6,722,539 | B2 | 4/2004 | Iitsuka | |
| 6,824,028 | B2 | 11/2004 | Mutai et al. | |
| 6,955,280 | B2 | 10/2005 | Saitoh et al. | |
| 8,499,986 | B2 | 8/2013 | Knight et al. | |
| 9,009,922 | B2 | 4/2015 | Perreault | |
| 9,248,565 | B1 * | 2/2016 | Latham | B25H 3/006 |
| 9,854,900 | B2 * | 1/2018 | Donnelly | A45F 5/00 |
| 2002/0170933 | A1 | 11/2002 | Martin | |
| 2003/0074803 | A1 | 4/2003 | Mutai et al. | |
| 2014/0310969 | A1 * | 10/2014 | Moreau | G01B 3/1041 33/769 |

OTHER PUBLICATIONS

"Sidewinder EVO Retractable Tether System" http://www.s4gear.com/pages/products/sidewinder-evo-php Oct. 23, 2015.
"Magnogrip Quick Snap Magnetic Tape Measure Holder" http://i.ebayirng.com Feb. 25, 2014.

* cited by examiner

TOOL RETAINING DEVICE

This application claims the benefit of priority to U.S. Provisional Patent Applications Ser. No. 62/182,330 filed on Jun. 19, 2015 and Ser. No. 62/268,228 filed on Dec. 16, 2015, the contents of both applications are incorporated by reference herein in their entireties.

FIELD OF THE INVENTION

The disclosure relates to a device for retaining a tool to a user. More particularly, the present disclosure relates to a device for removably securing a tool to a user.

BACKGROUND

When working with tools it is very common that the tool may be inadvertently separated. This can occur when a user drops it from their hands during use or when it falls from the user's tool belt or other retaining structure on the use. Often times it is during the act or removing and replacing a tool that the tool is accidentally dropped.

Inadvertent separation of a tool from a user can result in damage to the tool and increasing the time it takes to complete the job. Inadvertent separation is especially problematic when a user is working at heights and a falling tool poses a danger to people and property lying below. While devices for securing tools exist, they typically make it difficult for a user to remove and secure the tool.

Accordingly, it would be desirable to provide a tool retaining device that secures the tool against inadvertent separation from a user and also allows for the tool to be easily removed and retained and not impede the work being performed.

SUMMARY

The present disclosure provides a tool retaining device including a strapping material having pliable material which is adapted to be wrapped around a tool to secure the strapping material to the tool. The strapping material is securely retained to a mounting lug. The mounting lug is securable to a tool by a fastener. A securement device has a slot therein for lockingly receiving the lug, and the lug is removably securable to the securement device.

The present invention further provides a tool retaining device including a strapping material including pliable material which is adapted to be wrapped around a tool to secure the strapping material to the tool. The strapping material is securely retained to a mounting lug. The mounting lug is securable to a tool by a fastener. A securement device has a slot therein for receiving the lug. The lug is removably securable to the securement device. The securement device includes a locking member movably disposed above the securement device slot. The locking member has a first position extending over the slot to prevent the lug from being removed from the slot and a second position away from the slot to permit the lug to be removed from the slot.

The present invention still further provides a tool retaining device including a strapping material including pliable material which is adapted to be wrapped around a tool to secure the strapping material to the tool. The strapping material is securely retained to a mounting lug. The mounting lug is securable to a tool by a fastener. A securement device as a slot therein for receiving the lug. The lug is removably securable to the securement device. A locking member includes a cantilevered arm movably disposed above the securement device slot. The arm has a first position extending over the slot to prevent the lug from being removed from the slot and a second position away from the slot to permit the lug to be removed from the slot.

DETAILED DESCRIPTION OF THE PREFERRED EMBODIMENTS

Figure 1:
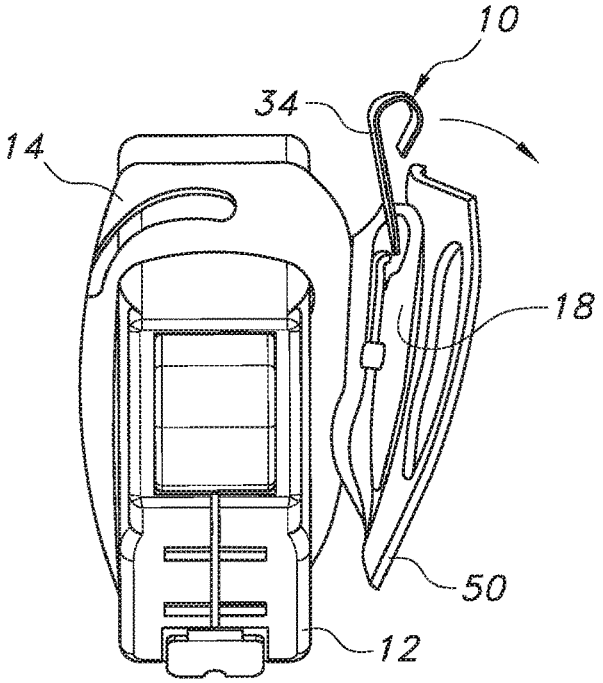
FIG. 1 is a top perspective view of a tool retaining device secured to a tool in the form of a tape measure.

The present disclosure is directed to a tool retaining device 10 shown in FIGS. 1-16. The tool retaining device 10 prevents a tool 12 from inadvertently becoming separated from a user. The tool retaining device 10 includes a strapping member 14 which surrounds the tool 12. The strapping member 16 is secured to an attachment lug 16. A securement device 18 receives the lug 16 and secures the tool 12 thereto. The securement device 18 may be fixedly attached to a user. The tool 12 may be in the form of a tape measure having a retractable measuring tape.

While the tool shown herein is in the form of a tape measure, it is within the contemplation of the present disclosure that tool retaining device 10 could be used to secure other types of tools such as hammers, screwdrivers, wrenches, cutting tools, hand held tools, or other types of tools.

The strapping material 14 may be pliable material formed of a resilient, stretchable material which snuggly and securely receives the tool 12. The strapping material 14 may be formed of a resilient material such as natural rubber, silicon, latex, or any other resilient stretchable material known in the art. The strapping material 14 may extend over the top and bottom of the tool 12. In addition, as shown in FIGS. 5-7 and 9, the strapping material 14 may be formed of a loop of material which is secured to the lug 16 by rivets 15 or other known fastening elements. The stretchable material allows the strapping material 14 to accommodate a wide range of tool sizes. Alternatively, the strapping material 14 may be formed of pliable non-stretchable material, such as leather, cloth, vinyl, or plastic that is sized to securely enwrap the tool 12 and closely conform to its exterior. Such strapping material may include a buckle, snaps, hook and loop fasteners, or other types of fastening devices known in the art to secure the strapping material 14 about the tool 12.

Figure 5:
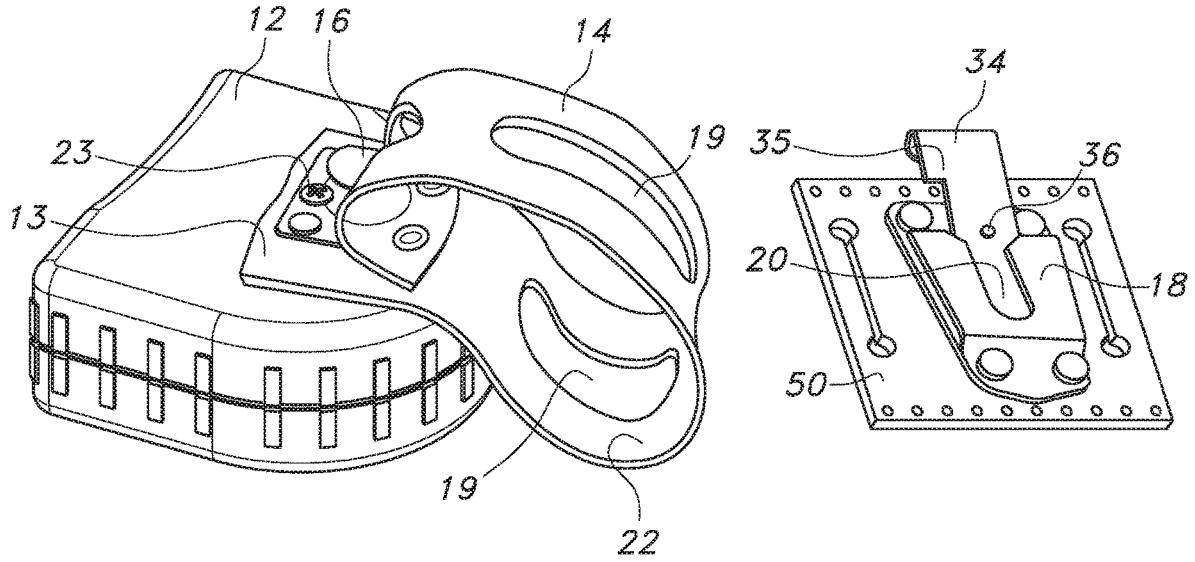
FIG. 5 is a side perspective view of the tool retaining device with the strapping member disengaged from the tool.
Figure 6:
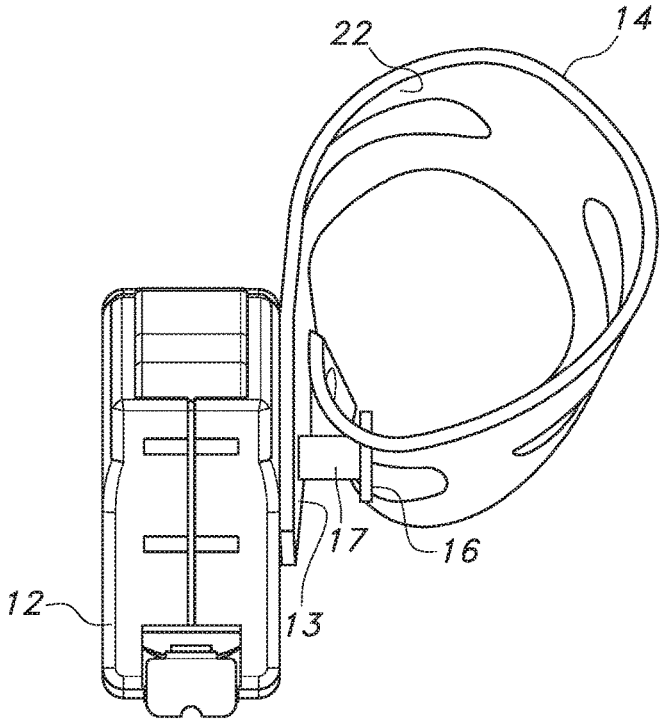
FIG. 6 is top perspective view of the tool retaining device with the strapping member disengaged from the tool.

The strapping material 14 may include an opening 17 therein in order to allow the lug 16 to protrude therefrom. The strapping material 14 may be in the form of a loop of material including a plurality of elongate openings or slots 19 forming relatively thin bands 22 which may help the strapping member stretch over the tool 10 and closely conform to the shape of the tool. Strapping member 14 is fixably secured to the lug 16 forming a tool harness. The lug 16 and the strapping material 14 attached thereto may be fixedly secured to the tool 12 by a fastening element 23, such as a screw. In one embodiment, the tool may be in the form of a tape measure. The standard belt clip (not shown) of the tape measure can be removed and the remaining female thread 25 can be engaged with a fastening element 23 in order to hold the lug 16 and strapping member 14 to the tool 12. The fastening element may extend through a hole in a plate portion of the lug. Accordingly, even when the strapping member 14 is not wrapped around the tool, such as shown in FIG. 5, the strapping member 14 is fixedly secured to the tool 12.

In addition, the strapping material 14 when it is wrapped around the tool secures the lug 16 to the tool 12 independent of the fastening element. Accordingly, if the fastening element 23 were to be removed from the tool 12, the lug 16 would still be secured to the tool 12 via the strapping material 14.

In an alternative embodiment, the strapping material and/or lug may be configured so as to receive the standard tool clip commonly found on tools such as tape measures. The strapping material and/or lug may include a slot therein for receiving the tool clip.

Figure 2:
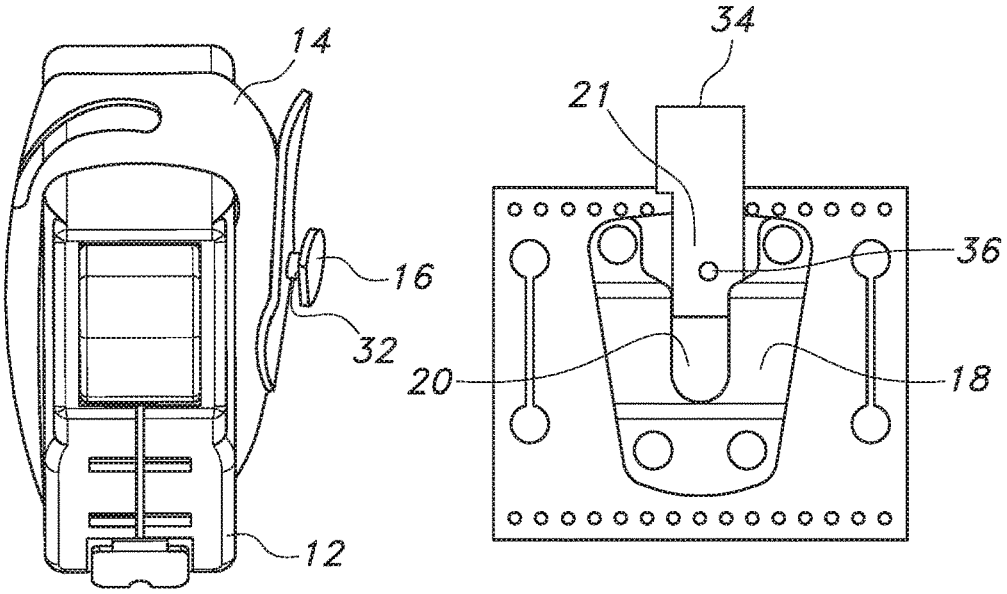
FIG. 2 is a top plan view of the tool retaining device attached to the tape measure and separated from a securement device.
Figure 3:
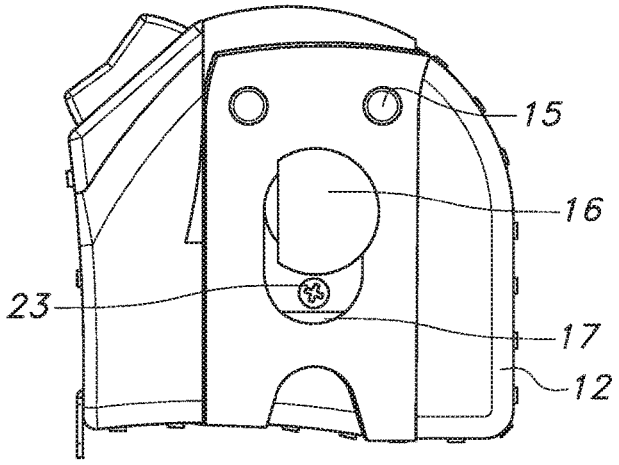
FIG. 3 is top plan view of the back side of the tool retaining device.
Figure 4:
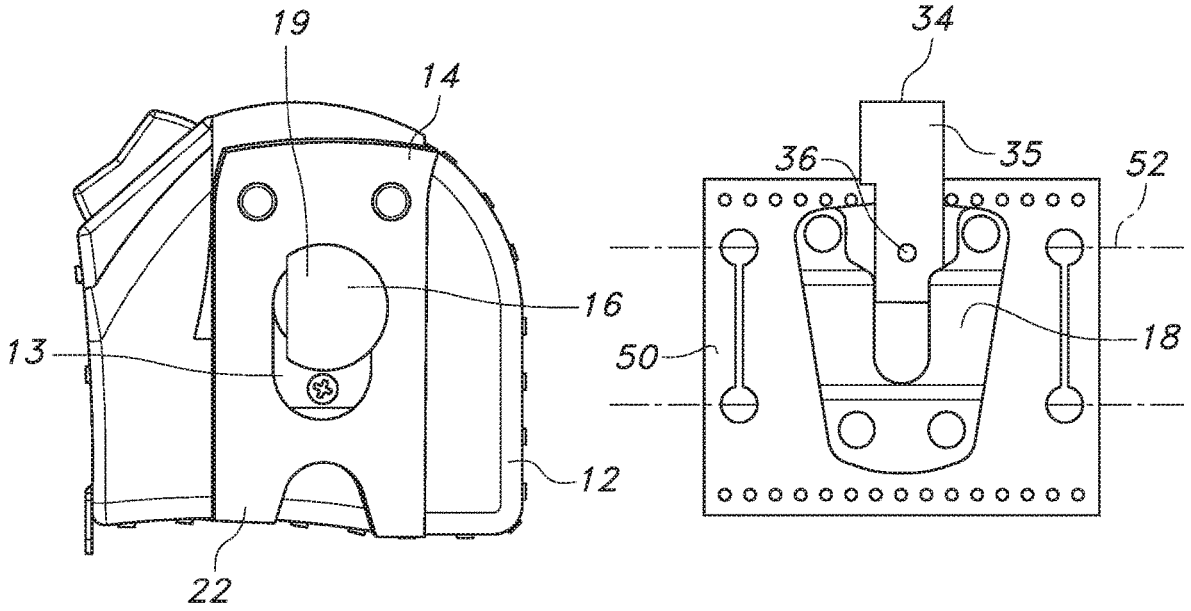
FIG. 4 is a top perspective view of the tool showing the lug and the securement device.

As shown in FIGS. 1-3, the strapping material 14 may be stretched in such a way that it extends around the tool 12 and securely retains the tool thereto. It is further contemplated that the strapping material may be sized and shaped to conform to the particular tool being secured. Accordingly, if the fastening element 23 securing the lug 16 to the tool 12 were to become separated, the tool 12 would still be fixably secured to the strapping material 14 and the lug 16. Accordingly, the lug 16 is secured to the tool 12 by two separate fastening devices, the strapping material 14 and the fastening element 23.

The lug 16 may have a base 13 from which extends a round post portion 17 which ends in a protruding flat cap 19. The strapping material 14 may be secured to the lug base 15. The lug 16 may be shaped to be lockingly received in the securement device 18. The lug 16, and the tool 12 to which it is attached, may rotate freely within the slot 20. For example, when the tool 12 is in the form of a tape measure, this ability of the tool to rotate when attached to the securement device 18 allows a user to use the tape measure with the tape measure still secured to the user via the securement device. In such an application, the securement device 18 with the tape measure attached would be secured to the user. The user would grab the end of the tape and pull it from the tape measure housing. The tape measure tool would rotate on the securement device 18 as the user manipulates the tape while taking a measurement. The rotation of the tape measure tool while still secured to the securement device 18 allows the user to easily extend and move the tape in various positions in order to take the measurement. When the measurement is completed, the tape would be retracted into the tape measure housing. Thus, a user may take a measurement without having to remove the tool from the securement device. In such an application of use, there is less opportunity for the tool to become inadvertently separated from the user and fall.

Figure 15:
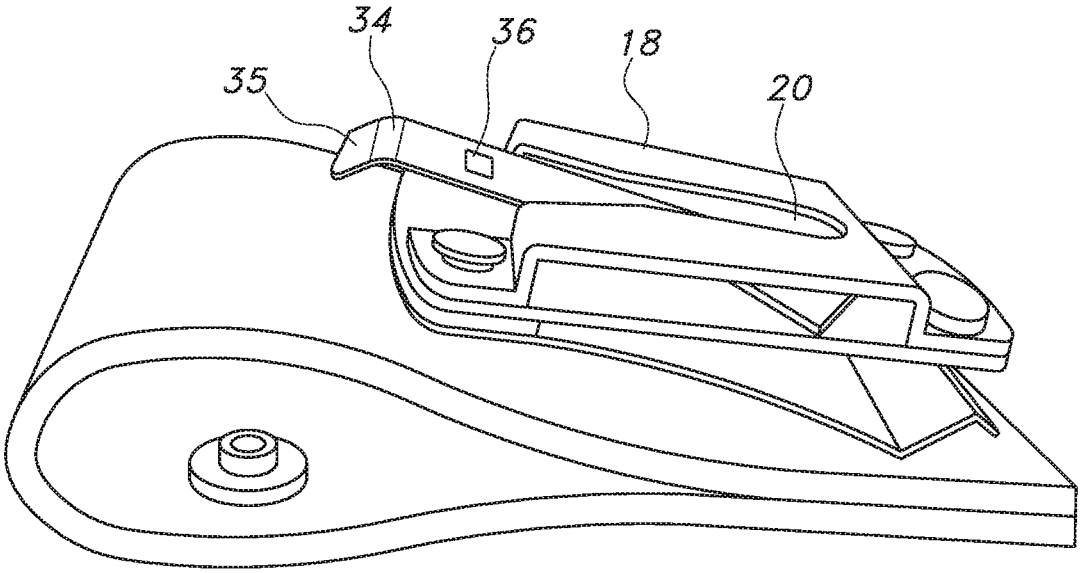
FIG. 15 is a side perspective view of an alternative embodiment of a securement device.

With reference to FIGS. 2, 5 and 15, the securement device 18 may include a U-shaped slot 20 having an open end 21 into which a lug end 32 may slide. Once within the slot 20, a locking member 34 resiliently extends over the lug and prevents it from being removed from the slot. The locking member may include a cantilevered resilient arm 35 having an outwardly extending protrusion 36. The arm 35 may be formed of resilient material such as spring steel. The protrusion 36 is disposed above the lug 16 when the lug is inserted into the slot 20, and the protrusion 36 restricts the lug 16 from moving out of the slot 20. The securement permits rotation of the tool 12, while preventing inadvertent separation of the tool from the securement device 18.

Figure 7:
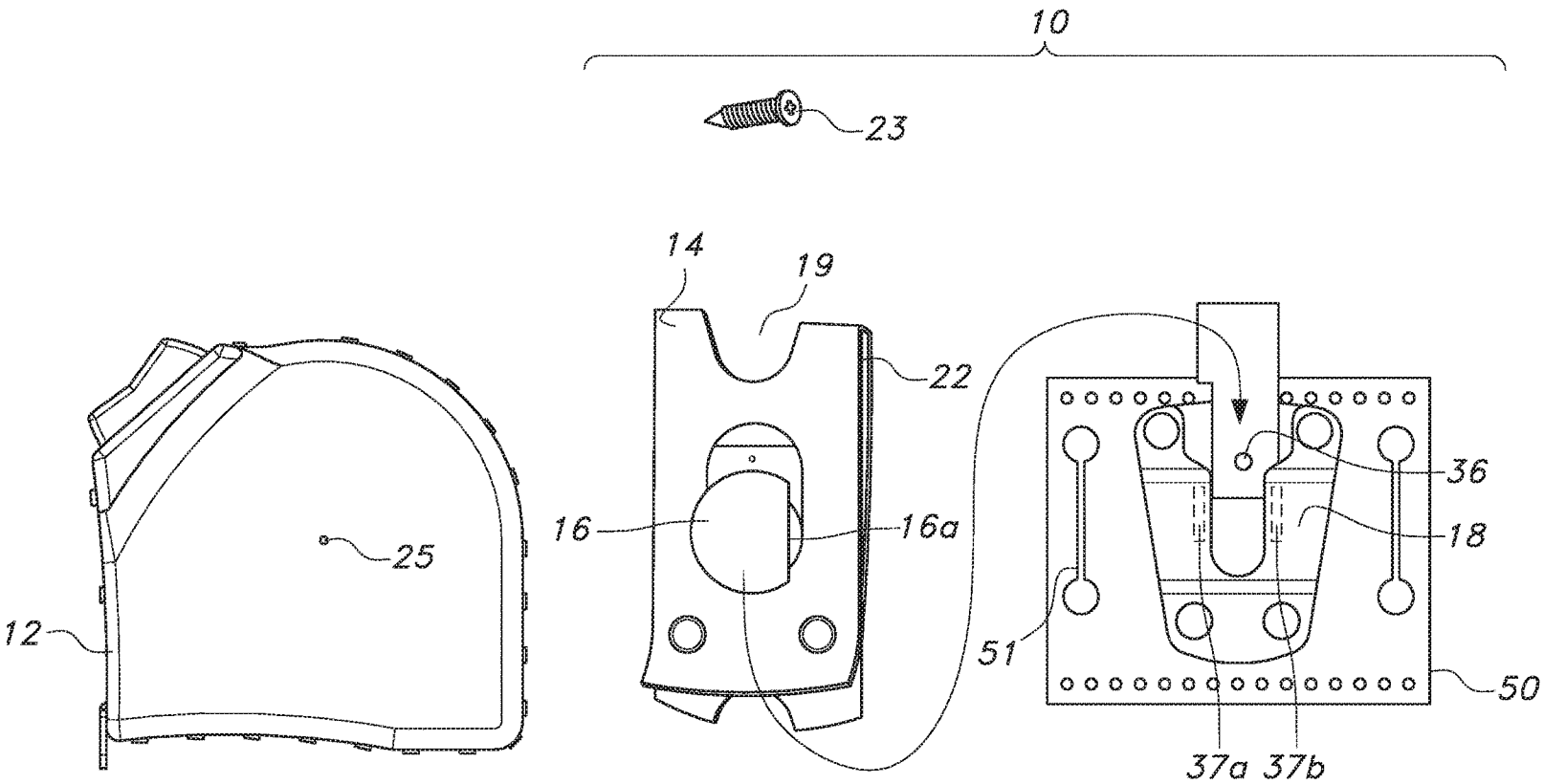
FIG. 7 is a top perspective view of the tool retaining device completely separated from the tool.
Figure 8:
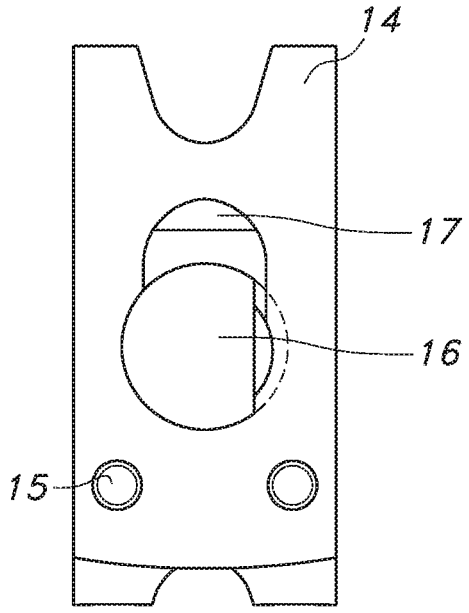
FIG. 8 is a top perspective view of the strapping member and lug.
Figure 9:
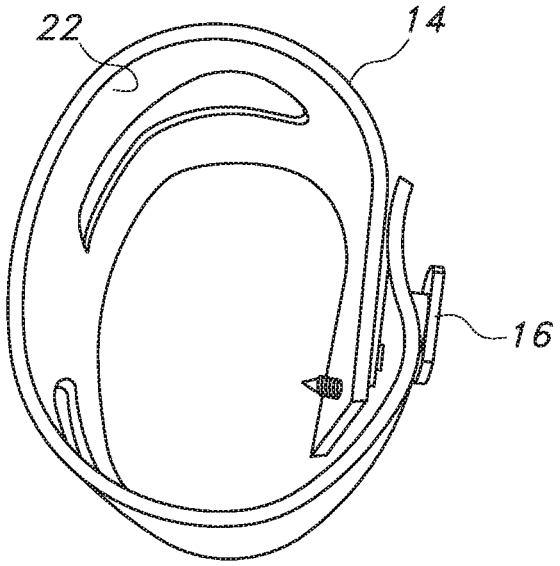
FIG. 9 is a side elevational view of the strapping member and lug.

In order to remove the lug 16 from the slot 20 and thus separate the tool 12 from the user, the user may urge the resilient locking member 34 away from the tool 12 and rotate the tool to a certain position in which it will allow the lug 16 to slide outwardly from the slot 20. In one embodiment, the securement device 18 and lug 16 may be configured such that the tool 12 would have to be rotated 180 degrees so that the tool is facing upside down in order for it to be removed. For example, the lug 16 may have a semi-circular configuration with a flat side 16*a*. In addition, the walls of the slot may have outwardly extending longitudinal protrusions 37*a* and 37*b* (FIG. 7). The distance between the protrusion 37*a* and 37*b* is such that the lug flat 16*a* must be longitudinally aligned with the protrusions to permit the lug to be removed. Therefore, when the tool is in the normal orientation, as shown in FIG. 1, the tool cannot be removed from the securement device even if the locking member 34 were to be depressed. Therefore, even if the locking member is inadvertently depresses the tool will remain secured to the securement device 18

In an alternative embodiment, the lug 16 may be insertable and removable from the securement device 18 without the need to rotate the lug to a particular position. In this embodiment, the user may urge the resilient locking member 34 and protrusion 36 away from the tool 12 and lift the tool away from the securement device 18. In this embodiment, the lug may be round, FIG. 8, and the securement device 18 has a complementary shaped slot in which to receive the lug such as shown in FIG. 15. This permits a user to remove the tool using one hand. For example, the user can actuate the locking member 34 with their thumb and lift the tool away from the securement device 18 with their other fingers.

Figure 16:
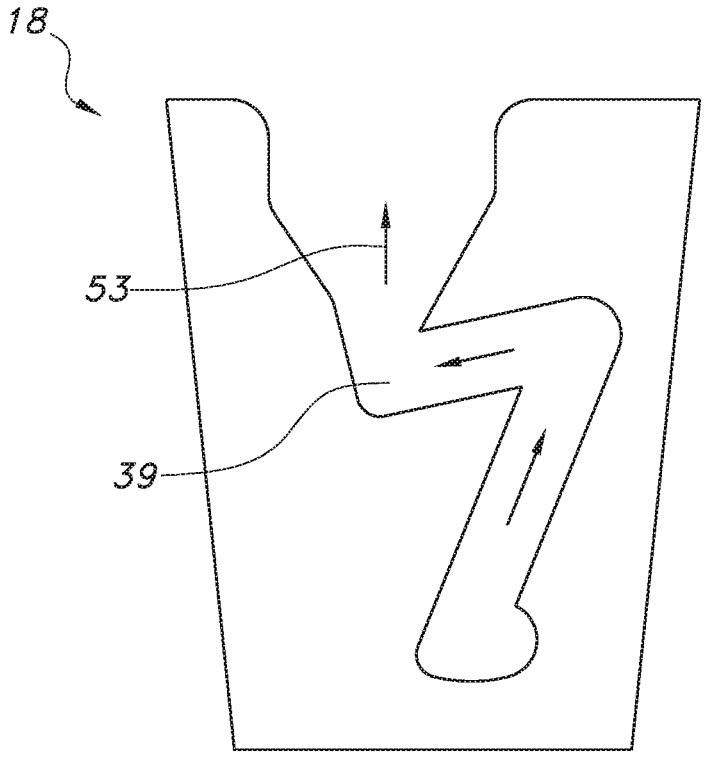
FIG. 16 is a front elevational view of a further alternative embodiment of a securement device.

With reference to FIG. 16, a further alternative embodiment is shown. The securement device 18 may include a non-linear slot 39 wherein the slot includes portions extending in different directions. The path is non-linear in that the slot changes direction as it extends from one end of the slot to the other. For example, the slot 39 may be an S-shape as shown in FIG. 16. It is contemplated that the slot 39 may be formed in a variety of non-linear shapes such as connected line segments going in different directions or curves, arcs, etc. In this way, the tool 12 secured to lug 16 may not be removed from the securement device 18 by moving the tool in one direction, thus reducing the chances of unintended separation of the tool from the securement device 18. Instead, removal of the tool from the securement device would require that the tool be moved in at least two different directions. For example, in the embodiment shown in FIG. 16, the arrows 53 show the non-linear removal path. The tool having a lug 16 attached thereto would have to move upwardly, then move to the side, and then upwardly again to be removed.

Figure 12:
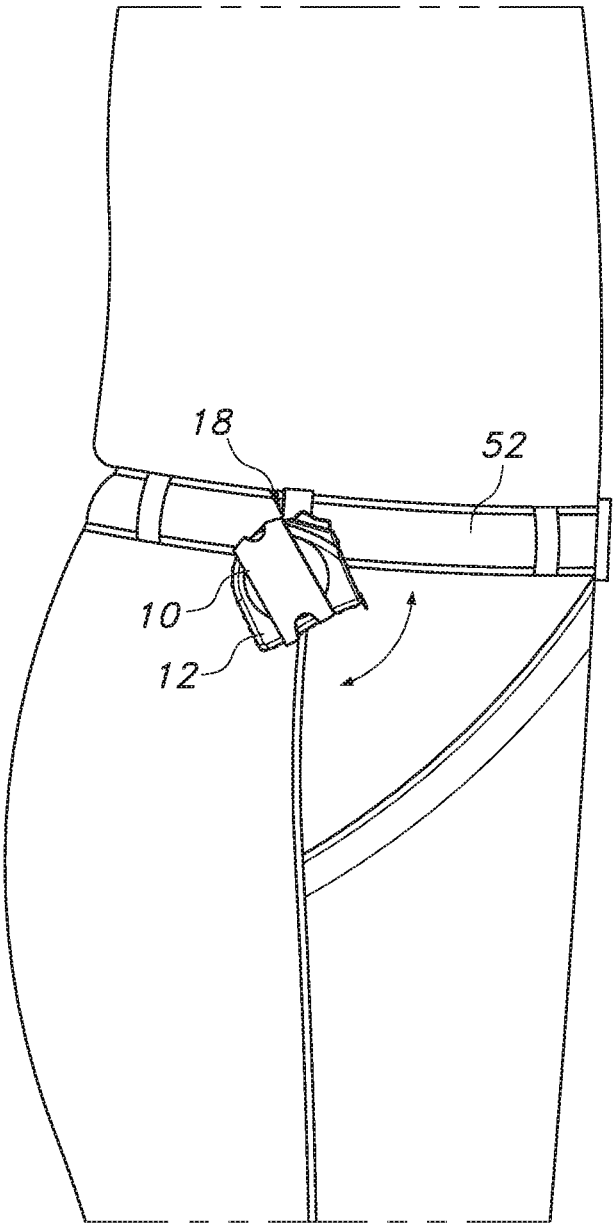
FIG. 12 is a perspective view of a tool secured to a user by the tool retaining device.
Figure 14:
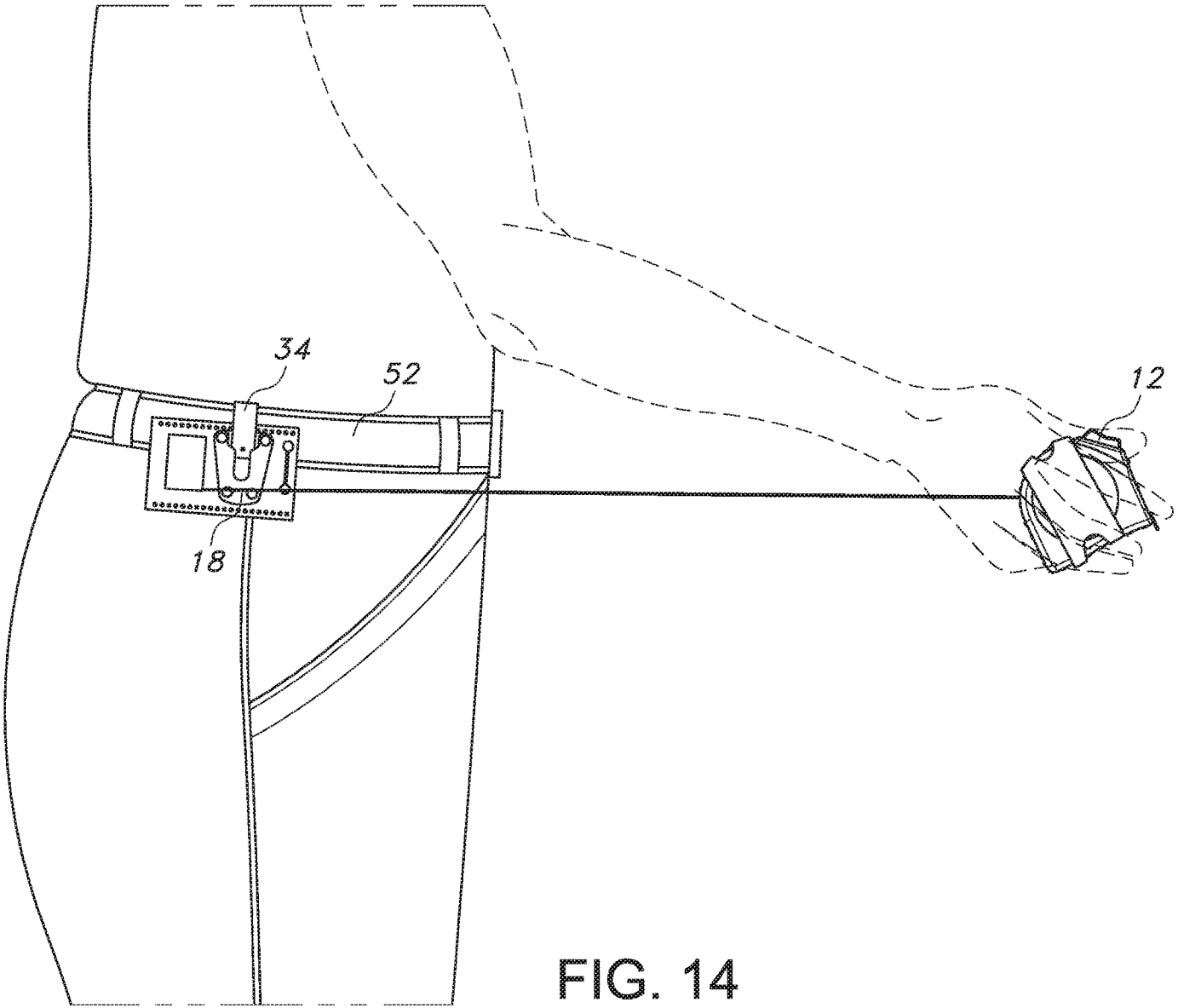
FIG. 14 is a side elevational view of a securement device including a retractable tether.

With reference to FIGS. 2 and 7, the securement device 18 may be secured to a piece of material 50 having slots 51 which can receive a belt worn around the waist of a user 52 as show in FIGS. 12 and 14. Alternatively, the securement device 18 may have a loop formed therein which receives a user's belt. In a further alternative embodiment the securement device 18 may have a clip on the rear side to permit it to be clipped to user's belt, clothing or other equipment. In still a further alternative embodiment, the securement device may be fastened directly to a belt, strap, or other equipment worn by a user.

Figure 10:
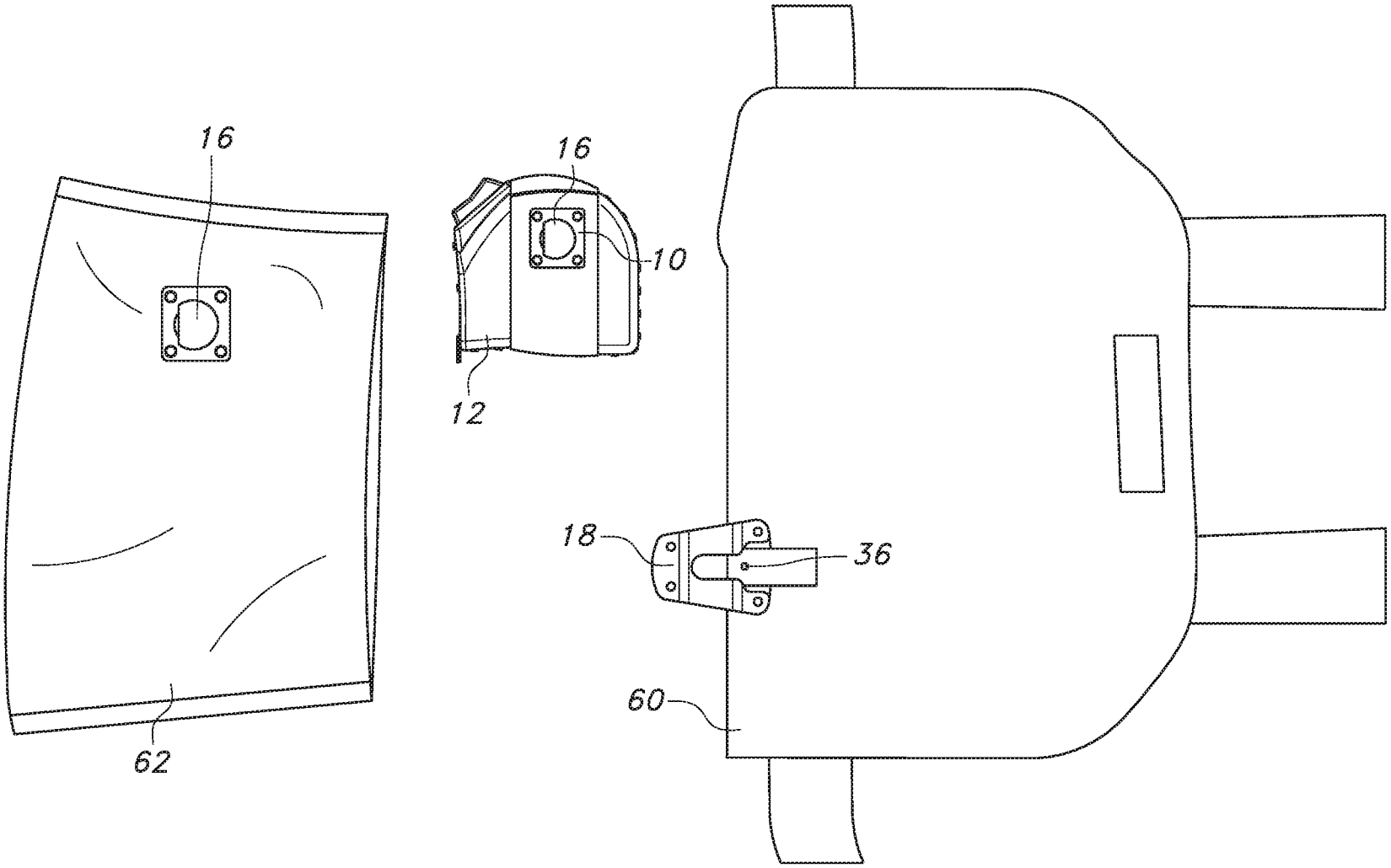
FIG. 10 is a top perspective view of the alternative embodiment showing a tool belt and pouch.
Figure 11:
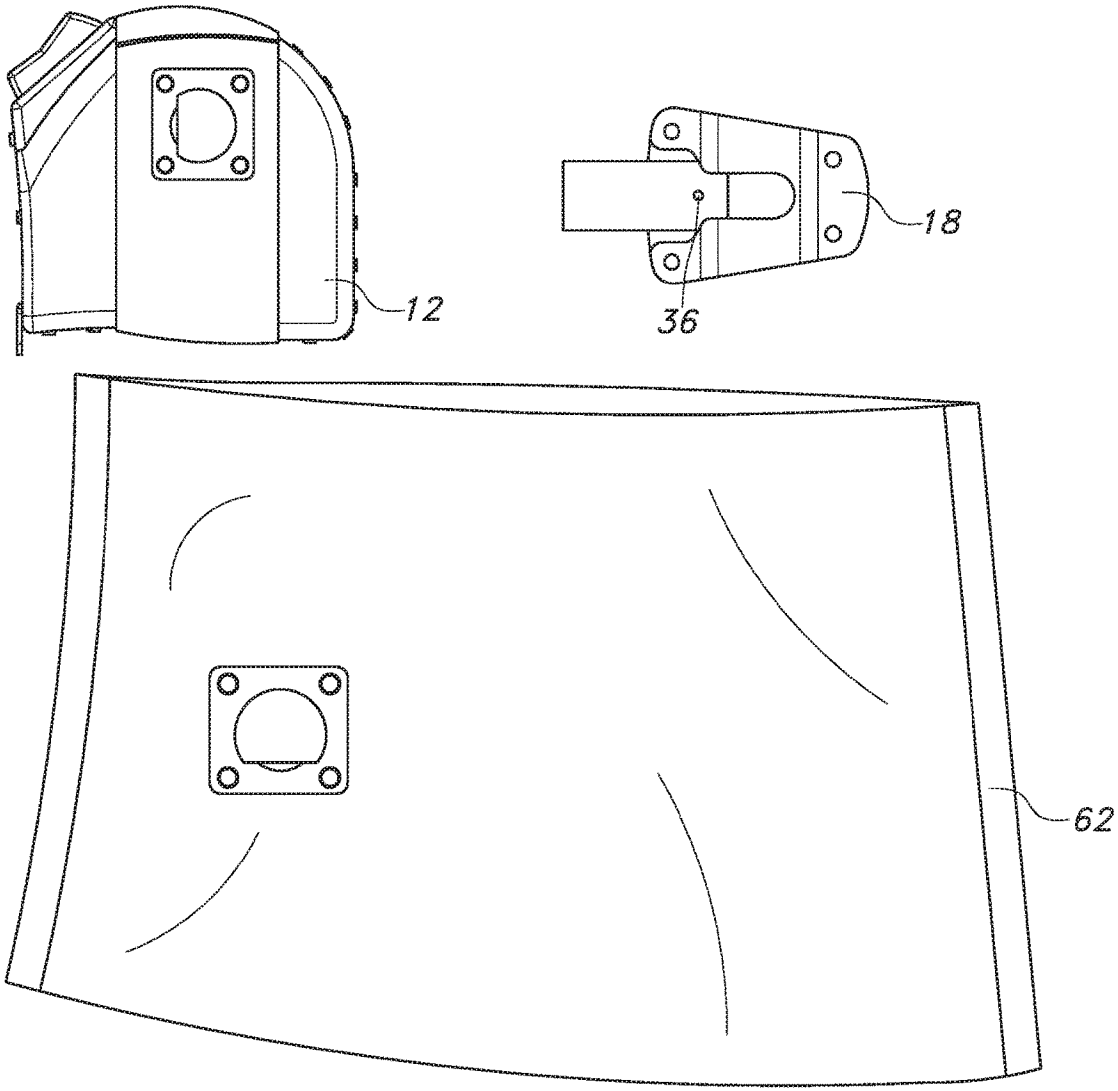
FIG. 11 is a top perspective view of the alternative embodiment in FIG. 10 showing the tool retaining device on a pouch.

With reference to FIGS. 10-11, the securement device 18 alternatively may be secured to a tool belt 60. In this way the tool 12 may be secured to the tool belt 60. In addition, a lug 16 may be attached to other items such as a tool pouch 62 and used to secure the pouch to the tool belt by a securement device 18.

When the tool 12 is secured to the securement device 18, the tool 12 may be freely rotated with respect thereto. Accordingly, a user can pull out the tape from the tape measure and use it for measuring even when the tape measure is secured to the user by the tool retaining device 10.

As noted above, the tool retaining device 10 provides for two manners of securing the lug 16 to the tool 12, the strapping material 14 and the fastening element 23. Accordingly, if either the strapping material or the fastening element 23 should separate from the tool, the lug 16 will still be securely held to the tool 12. Therefore, when the lug 16 is in the securement device 18 attached to a user, the tool 12 will be securely retained to the user even if one of the strapping material 14 or fastening element 23 should become disengaged from the tool 12. Therefore, the tool is securely retained to a user and is prevented from accidentally or inadvertently becoming separated from the user and falling.

Figure 13:
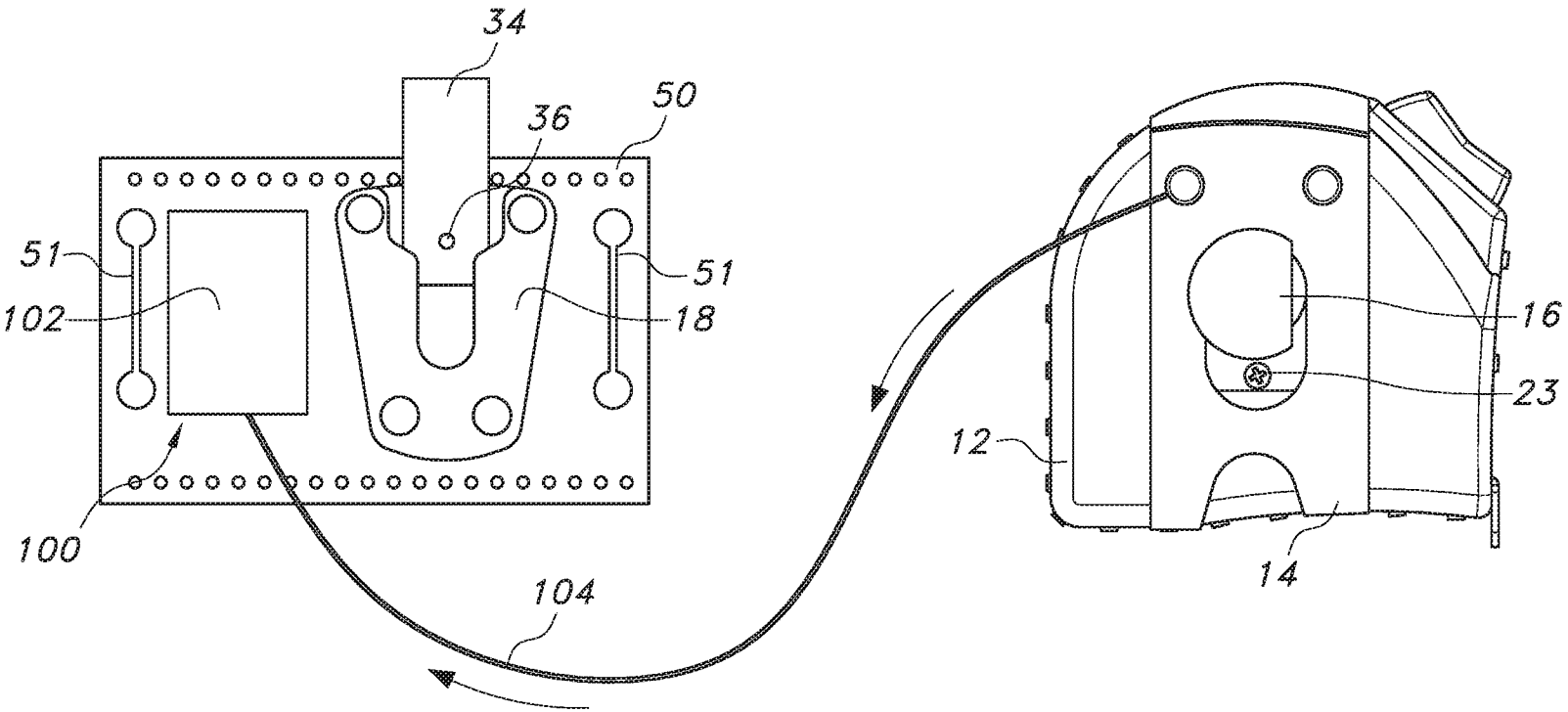
FIG. 13 is a side elevational view of a tool retaining device including a tether secured to a user.

With reference to FIGS. 13 and 14, in an alternative embodiment, the tool retaining device may include a tether device 100 for securing the tool to the securement device 18. The tether device 100 may include a housing 102 with a retractable and extendable cord 104 having one end secured to the strapping material 14 and/or lug 16 of the tool harness. The other end of the cord may be secured to or adjacent to the securement device 18. In one embodiment shown in FIG. 13, the tether device may be secured to the same piece of material 50 to which the securement device is secured. The tether device housing 102 may include within a spring loaded retraction mechanism (not shown) that permits the cord to be extended and also winds up the cord. Such cord retracting mechanisms are described in U.S. Pat. Nos. 5,697,572 and 5,094,396, both of which are incorporated by reference herein for all purposes. The tether prevents the tool 12 from falling away from the user should the tool be dropped during use. The extendable tether further permits the tool 12 to be removed from the securement device 18 and used while the tether still connects the tool to the securement device 18.

Alternatively, the tether may be a cord or elastic cord that is secured to and between the tool and user.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A tool retaining device comprising:

a strapping material including pliable material which is adapted to be wrapped around a tool to secure the strapping material to the tool, the strapping material forming a sleeve having an annular wall defining a space for elastically receiving therein the tool, the strapping material including a plurality of elongate slots forming elastic bands which facilitate stretching of the strapping material;

the sleeve having two ends securely retained to a mounting lug, the mounting lug having an opening for receiving a fastener, and the mounting lug being securable to the tool by the fastener, the fastener adapted to secure the lug to the tool independent of the strapping material; and a securement device adapted to be connected to a user and having a slot therein for lockingly receiving the lug, the lug being removably securable to the securement device, the lug being freely rotatable in the slot.

2. The tool retaining device as defined in claim 1, wherein the lug is removable from the securement device in a first predetermined position and non-removable from the securement device in a second predetermined position.

3. The tool retaining device as defined in claim 1, wherein the lug is removable from the securement device in any position.

4. The tool retaining device as defined in claim 3, wherein the strapping material and lug form a tool harness and a tether is secured between the tool harness and the securement device.

5. The tool retaining device as defined in claim 1, wherein the elongate slots extend in the circumferential direction of the sleeve.

6. The tool retaining device as defined in claim 1, wherein a cantilevered locking member is movably disposed above the securement device slot, the locking member having a first position extending over the slot to prevent the lug from being removed from the slot and a second position away from the slot to permit the lug to be removed from the slot.

7. The tool retaining device as defined in claim 1, wherein the strapping material and lug form a tool harness and a tether is secured between the tool harness and the securement device.

8. The tool retaining device as defined in claim 1, wherein the slot has a non-linear configuration.

9. A tool retaining device comprising:

a strapping material including pliable material which is adapted to be wrapped around a tape measure to secure the strapping material to the tape measure, the strapping material forming a sleeve having an annular wall defining a space for elastically receiving therein the tape measure, the strapping material having two ends securely retained to a mounting lug, the mounting lug being securable to the tape measure by a fastener, wherein the fastener secures the lug to the tape measure independent of the strapping material;

a securement device having a slot therein for receiving the lug, the lug being removably securable to the securement device; and a locking member including a cantilevered arm movably disposed above the securement device slot, the arm having a protrusion having a first position extending over the slot to prevent the lug from being removed from the slot and a second position away from the slot to permit the lug to be removed from the slot, and wherein the tape measure is freely rotatable with respect to the securement device, and the tape measure having a retractable measuring tape which is extendable from a housing for measuring while the tape measure remains rotatably secured to the user.

10. The tool retaining device as defined in claim 9, wherein the lug is removable from the securement device in a first predetermined position and non-removable from the securement device in a second predetermined position.

11. The tool retaining device as defined in claim 9, wherein the lug is removable from the securement device in any position.

12. A tool retaining device comprising:

a tape measure having a housing containing a retractable measuring tape;

a strapping material including pliable material which is adapted to be wrapped around the tape measure to secure the strapping material to the tape measure, the strapping material having an annular wall forming a continuous uninterrupted loop defining a space for elastically receiving therein the tape measure the strapping material having two ends securely retained to a mounting lug, the mounting lug having an opening for receiving a fastener, and the mounting lug being secured to the tape measure by the fastener, the fastener adapted to secure the lug to the tape measure independent of the strapping material; and a securement device adapted to be secured to a user, the securement device having a slot therein for lockingly receiving the lug, the lug being removably securable to the securement device, and wherein the tape measure is freely rotatable with respect to the securement device such that the measuring tape is extendable from the housing for measuring while the tape measure is rotatably secured to the user.

13. The tool retaining device as defined in claim 12, wherein the mounting lug being disposed on the annular wall between a plurality of elongate slots.

14. A method for using a measuring tape compromising:

obtaining a tape measure having a housing containing a retractable measuring tape, and a strapping material including pliable material which is adapted to be wrapped around the tape measure to secure the strapping material to the tape measure, the strapping material forming a sleeve having an annular wall defining a space for elastically receiving therein the tape measure, the strapping material including a plurality of elongate slots forming elastic bands which facilitate stretching of the strapping material; the sleeve having two ends securely retained to a mounting lug, the mounting lug having an opening for receiving a fastener, and the mounting lug being securable to the tape measure by the fastener, the fastener adapted to secure the lug to the tape measure independent of the strapping material; and a securement device adapted to be connected to a user and having a slot therein for lockingly receiving the lug, the lug being removably securable to the securement device, the lug being freely rotatable in the slot attaching the securement device to a user;

inserting the mounting lug in the securement device slot wherein the mounting lug is lockingly received in the securement device;

extending the measuring tape from the housing wherein the tape measure rotates relative to the securement device; and taking a measurement with the measuring tape with the tape measure secured to the user.

* * * * *